US010130132B2

(12) United States Patent
Kim et al.

(10) Patent No.: US 10,130,132 B2
(45) Date of Patent: Nov. 20, 2018

(54) HAIR BUNDLE APPARATUS AND METHOD OF MANUFACTURING SAME

(71) Applicant: SHAKE-N-GO FASHION, INC., Port Washington, NY (US)

(72) Inventors: James K. Kim, Manhasset, NY (US); Peter Ough, Manhasset, NY (US); Hye Sun Kim, Port Washington, NY (US)

(73) Assignee: SHAKE-N-GO FASHION, INC., Port Washington, NY (US)

( * ) Notice: Subject to any disclaimer, the term of this patent is extended or adjusted under 35 U.S.C. 154(b) by 0 days.

(21) Appl. No.: 15/424,325

(22) Filed: Feb. 3, 2017

(65) Prior Publication Data

US 2017/0224036 A1 Aug. 10, 2017

Related U.S. Application Data

(60) Provisional application No. 62/407,212, filed on Oct. 12, 2016, provisional application No. 62/291,814, filed on Feb. 5, 2016.

(51) Int. Cl.

| | |
|---|---|
| ***A41G 3/00*** | (2006.01) |
| ***A41G 5/00*** | (2006.01) |
| *A45D 8/36* | (2006.01) |

(52) U.S. Cl.

CPC ..... *A41G 5/0046* (2013.01); *A41G 5/006* (2013.01); *A41G 5/0073* (2013.01); *A41G 5/0086* (2013.01); *A41G 5/0093* (2013.01); *A41G 5/004* (2013.01); *A45D 8/36* (2013.01)

(58) Field of Classification Search

CPC ... A45D 8/14; A45D 8/32; A45D 8/34; A41G 5/00; A41G 5/004; A41G 5/0046; A41G 5/006; A41G 3/0066

See application file for complete search history.

(56) References Cited

U.S. PATENT DOCUMENTS

| | | | | |
|---|---|---|---|---|
| 1,519,107 | A * | 12/1924 | Breslauer | A41G 5/00 132/53 |
| 2,531,685 | A | 11/1950 | Jacoby | |
| 3,910,291 | A | 10/1975 | Kim | |
| 4,369,690 | A | 1/1983 | Sapkus | |
| 4,982,748 | A | 1/1991 | Trimarchi | |

(Continued)

FOREIGN PATENT DOCUMENTS

| | | | |
|---|---|---|---|
| FR | 2907641 | A1 | 5/2008 |
| JP | 2008202199 | A | 9/2008 |

(Continued)

OTHER PUBLICATIONS

International Search Report, for International application No. PCT/US2017/016515.

*Primary Examiner* — Rachel R Steitz

(74) *Attorney, Agent, or Firm* — Cowan, Liebowitz & Latman, P.C.; Mark Montague; Brian R. Volk

(57) ABSTRACT

A hair bundle apparatus is provided. The hair bundle apparatus includes: a first section comprising a loop member, a first end and a second end, wherein the first section is constructed of a first material comprising one of synthetic hair, an elastic band, wire, and thread; a second section comprising a locking member; and a third section comprising a third end and a fourth end, wherein the third section is constructed of a second material comprising human hair.

12 Claims, 6 Drawing Sheets

(56) References Cited

U.S. PATENT DOCUMENTS

| | | | | |
|---|---|---|---|---|
| 5,634,478 | A | 6/1997 | Shakir | |
| 5,758,670 | A | 6/1998 | Ogunro | |
| 5,899,211 | A * | 5/1999 | Brown | A41G 5/00 132/201 |
| 6,109,275 | A | 8/2000 | Mendezmonsanto | |
| 6,263,884 | B1 * | 7/2001 | Minnelli | A45D 8/34 132/201 |
| 6,691,714 | B1 | 2/2004 | Yaguchi et al. | |
| 7,854,233 | B2 | 12/2010 | Freelove | |
| 8,511,320 | B2 | 8/2013 | Sakurai et al. | |
| 8,528,571 | B2 | 9/2013 | Costa | |
| 2008/0072920 | A1 | 3/2008 | Ladue | |
| 2009/0272396 | A1 | 11/2009 | Tochioka | |
| 2011/0220136 | A1 | 9/2011 | Kang | |
| 2013/0263884 | A1 * | 10/2013 | Hogan | A45D 8/34 132/273 |
| 2013/0312781 | A1 | 11/2013 | Murphy | |

FOREIGN PATENT DOCUMENTS

| | | | |
|---|---|---|---|
| KR | 557295 | B1 | 3/2006 |
| KR | 20140003350 | U | 11/2014 |
| WO | 2005044032 | A1 | 5/2005 |
| WO | 2010107144 | A1 | 9/2010 |

* cited by examiner

HAIR BUNDLE APPARATUS AND METHOD OF MANUFACTURING SAME

CROSS REFERENCE TO RELATED APPLICATIONS

This application claims priority to U.S. Provisional Patent Application No. 62/291,814 filed on Feb. 5, 2016 and U.S. Provisional Patent Application No. 62/407,212 filed on Oct. 12, 2016, the entire content of each of which is incorporated herein by reference.

BACKGROUND

1. Field of the Invention

The present application relates generally to hair extensions and, in particular, to a hair bundle apparatus and a method of manufacturing the same.

2. Description of Related Art

Consumers generally prefer hair extensions and wigs made of human hair due to the natural appearance and ease of care. However, hair extensions and wigs made of human hair are expensive, with the cost exponentially increasing as the length of the human hair increases. For example, human hair having a length of 10-18 inches is considered to be the longest human hair that can be cost-effectively incorporated into a hair extension or wig. Synthetic hair provides a more cost effective alternative to human hair, but does not have a natural look and feel, and tangles easily.

Recently, crochet cap-style wigs have become more desirable to consumers. A crochet cap wig generally includes a mesh cap configured to fit around a human head and a filament attached to the mesh cap according to a predetermined pattern. The filament may be, for example, a braid of synthetic hair that traverses the mesh cap from one side to the other in multiple rows. Bundles of hair are folded in half to form a loop and then the loop is crocheted to the filament. Similarly, bundles of hair can be crocheted directly to a user's hair. The user may style their hair in, for example, a corn-row style, and the bundles of hair are crocheted to the user's corn-row.

The bundles of hair utilized for crocheting to a wig or directly to a user's hair are exclusively made of synthetic hair. This is because the bundles of hair must be configured in a loop to be crocheted to the mesh cap. To be configured in a loop, the hair that makes up the bundle of hair must be of a desirable length after being looped to be attractive to the user. That is, the length of hair that makes of the bundle of hair must be double the desired length since the hair must be folded in half to form the loop.

SUMMARY

According to embodiments of the present invention, a hair bundle apparatus is provided. The hair bundle apparatus includes: a first section comprising a loop member, a first end and a second end, wherein the first section is constructed of a first material comprising one of synthetic hair, an elastic band, wire, and thread; a second section comprising a locking member; and a third section comprising a third end and a fourth end, wherein the third section is constructed of a second material comprising human hair.

According to further embodiments: the second section is disposed between the first section and the third section; the first material and the second material overlap in the second section; the locking member is configured to couple the first section to the third section; the first end and the second end overlap the third end in the second section; the fourth end is disposed outside of the second section.

According to an additional embodiment, a hair bundle apparatus is provided. The hair bundle apparatus includes: a loop section comprising a loop member, a first end and a second end, wherein the loop section is constructed of a first material comprising one of synthetic hair, an elastic band, wire, and thread; a first hair coupling section comprising a first locking member; a second hair coupling section comprising a second locking member; a first hair section comprising a third end and a fourth end, wherein the first hair section is constructed of a second material comprising human hair; and a second hair section comprising a fifth end and a sixth end, wherein the second hair section is constructed of a third material comprising human hair.

According to further embodiments: the first hair coupling section is disposed between the loop section and the first hair section, and wherein the second hair coupling section is disposed between the loop section and the second hair section; the first end of the loop section is disposed in the first hair coupling section, and wherein the second end of the loop section is disposed in the second hair coupling section; the third end of the first hair section is disposed in the first hair coupling section, and wherein the fifth end of the second hair coupling section is disposed in the second hair coupling section; the first material overlaps with the second material in the first hair coupling section, and wherein the first material overlaps with the third material in the second hair coupling section; the locking member contacts substantially all of the first material in the first hair section and substantially all of the third material in the second hair section; the loop section does not comprise human hair.

According to an additional embodiment, a method of manufacturing a hair bundle apparatus is provided. The method includes: providing a first section of the hair bundle apparatus comprising a loop member, a first end and a second end, wherein the loop member is constructed of a first material comprising one of synthetic hair, an elastic band, wire, and thread; twisting the first end and the second end a predetermined number of degrees of rotation; providing a second section of the hair bundle apparatus comprising a locking member; providing a third section of the hair bundle apparatus constructed of a second material comprising human hair; and coupling the third section of the hair bundle apparatus to the first section using the locking member.

According to further embodiments: prior to coupling the third section to the first section, the second material is coupling to a filament to form a weft, the weft comprising a first weft end and a second weft end; prior to coupling the third section to the first section, the first weft end and the second weft end of the weft is wrapped around the first end and the second end of the first section and then the third section of the hair bundle apparatus is coupled to the first section; the locking member is secured around the third section using an adhesive substrate; the human hair of the third section is coupled to the filament to form the weft comprises sewing the human hair of the third section to the filament; prior to coupling the third section to the first section, the weft is cut into a plurality of wefts such that the human hair coupled thereto comprises a predetermined weight of about 0.5 g to 3.0 g; the predetermined number of degrees of rotation comprises about 180 degrees; the first end and the second end of the first section overlap with the third section in the second section.

According to an additional embodiment, a method of manufacturing a hair bundle apparatus. The method includes: providing a loop section comprising a loop member, a first end and a second end, wherein the loop section is constructed of a first material comprising one of synthetic hair, an elastic band, wire, and thread; providing a first hair coupling section comprising a first locking member; providing a second hair coupling section comprising a second locking member; providing a first hair section comprising a third end and a fourth end, wherein the first hair section is constructed of a second material comprising human hair; providing a second hair section comprising a fifth end and a sixth end, wherein the second hair section is constructed of a third material comprising human hair; coupling the first end of the loop section to the first hair section using the first locking member and coupling the second end of the loop section to the second hair section using the second locking member.

According to further embodiments: prior to coupling the first end of the loop section to the first hair section and prior to coupling the second end of the loop section to the second hair section, the second material is coupled to a first filament to form a first weft, the first weft comprising a first weft end and a second weft end and the third material is coupled to a second filament to form a second weft, the second weft comprising a third weft end and a fourth weft end; prior to coupling the first end of the loop section to the first hair section and prior to coupling the second end of the loop section to the second hair section, the first weft end and the second weft end of the first weft is wrapped around the first end of the loop section and the third weft end and the fourth weft end of the second weft is wrapped around the second end of the loop section and then the first end of the loop section is coupled to the first hair section and coupling the second end of the loop section to the second hair section; the first locking member and the second locking member is secured around the first hair section and the second hair section, respectively, using an adhesive substrate; the second material is coupled to the first filament and the third material is coupled to the second filament by sewing the second material to the first filament and sewing the third material to the second filament; the first weft and the second weft comprise a predetermined weight of about 0.5 g to 3.0 g; the first end of the loop section is disposed in the first hair coupling section, wherein the second end of the loop section is disposed in the second hair coupling section, wherein the third end of the first hair section is disposed in the first hair coupling section, and wherein the fifth end of the second hair coupling section is disposed in the second hair coupling section; the first material overlaps with the second material in the first hair coupling section, and wherein the first material overlaps with the third material in the second hair coupling section; the loop section does not comprise human hair.

According to an additional embodiments, a hair bundle apparatus is provided. The hair bundle apparatus includes: a bundle of hair comprising multiple strands of human hair, wherein the strands of human hair comprise a first end, a second end, a first region, a second region and a third region; the first region being disposed at the first end and comprising a locking member that secures the strands of human hair together; an adjustable wrap member configured to couple the second region to the third region.

According to further embodiments: the adjustable wrap member couples the second region to the third region by wrapping around the second region and the third region; the second region comprises a loop region of a predetermined length; the strands of human hair in the loop region comprise a predetermined number of rotations such that the strands of human hair comprise a twisted configuration; the adjustable wrap member is configured to slide up and down along the first region and the second region, making the loop region smaller and larger, respectively; and the third region is disposed at the second end of the strands of human hair; the strands of human hair in the third region are not constrained.

According to a further embodiment, a method of manufacturing the above hair bundle apparatus is provided. The method includes: securing the first region with the locking member at the first end; securing the third region; turning the first region to form the loop member; rotating the first region a predetermined number of rotations; and coupling the adjustable wrap member to the second region and the third region.

BRIEF DESCRIPTION OF THE DRAWINGS

The above and other aspects, features and advantages of certain embodiments will be more apparent from the following detailed description taken in conjunction with the accompanying drawings, in which.

DETAILED DESCRIPTION OF THE PRESENT INVENTION

Figure 1A:
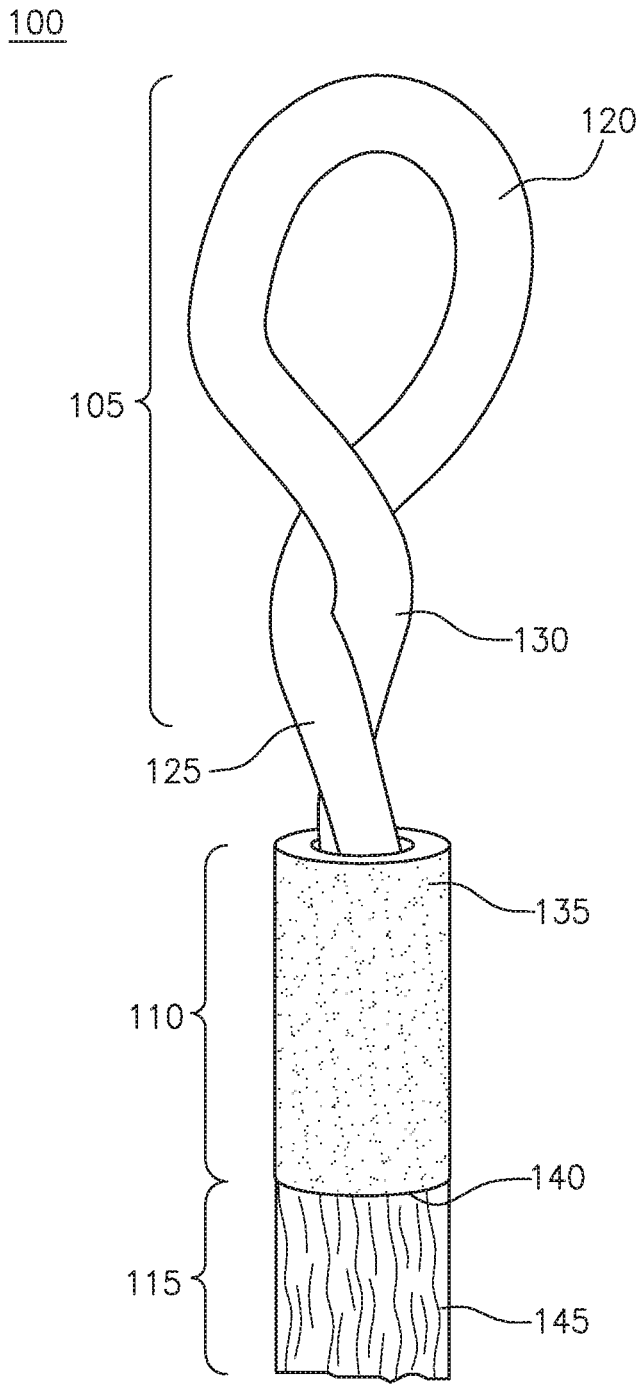
FIG. 1A illustrates a hair bundle apparatus according to a first embodiment of the present invention.

The following detailed description of certain embodiments will be made in reference to the accompanying drawings. In the detailed description, explanation about related functions or constructions known in the art are omitted for the sake of clearness in understanding the concept of the invention, to avoid obscuring the invention with unnecessary detail. Reference to individual embodiments, whether by number of embodiment or relevant feature of the embodiment, is used for convenience in describing such embodiments. Moreover, reference to individual embodiments does not indicate that any of such embodiments are preferred over any other embodiments. Each individual embodiment may be combined with any other individual embodiment whether or not expressly stated.

The present invention provides consumers with a cost-effective and high-quality hair extension. Consumers prefer to use hair extensions and wear wigs made out of human hair. Human hair increases in cost as the length of the hair increases. As a result, hair extensions and wigs made out of human hair are generally only made up to certain lengths, e.g., less than about 18 inches. Furthermore, wigs made out of human hair are generally made with wefts of hair in which individual strands of hair are permanently attached to a filament. Thus, conventional wigs that are made with human hair lack the ability to be customized according to various styles and appearances preferred by consumers.

As further described herein, embodiments of the present invention provide a bundle of hair, a method of manufacturing a bundle of hair, and a method of securing the bundle of hair to a user's natural hair. The bundle of hair can be used with a crochet-style wig or applied directly to a user's hair by, for example, crocheting the bundle of hair to the user's cornrow or braid. According to certain embodiments, the bundle of hair includes a section of, for example, synthetic hair, a section of human or natural hair, and a blended section of hair where the section of synthetic hair and the section of human or natural hair meet and are blended together. The phrase "natural hair" refers to both human and animal hair, and combinations thereof, suitable for use with wigs and hair extensions. The phrase "human hair" refers to hair grown by humans. The natural or human hair can be embodied in straight and curly textures. Length of the natural or human hair can vary from about 6 inches to about 24 inches, in certain embodiments from about 10 to about 18 inches. The weight of each hair bundle is approximately 0.5 to 3 grams, or about 1 to 2 grams. The section of synthetic hair includes two ends. The two ends of the synthetic hair are blended with the section of natural or human hair at the blended section of hair. The section of synthetic hair also includes a loop member. The loop member is configured to be crocheted to a filament of a mesh cap or directly to a user's hair.

According to further embodiments of the invention, a bundle of human hair is provided. The bundle of hair is configured to have a loop region that can be coupled to a crochet-style wig or directly to a user's hair, e.g., a user's corn row braid. The loop region of the hair bundle is turned into a U-shape, and the hair is then rotated, causing the loop region to twist. The hair bundle is then secured in this configuration. According to the above, consumers can have the benefits of a hair extension or wig made of human hair that is easily customizable to their desired appearance and style.

FIG. 1A illustrates a hair bundle apparatus 100 according to a first embodiment of the present invention. A method of manufacturing the hair bundle apparatus 100 is also provided herein. The hair bundle apparatus 100 includes multiple separate sections, which are herein described, such sections being coupled together into one integrated object. The hair bundle apparatus 100 includes a first section 105, a second section 110, and a third section 115. The second section 110 is disposed between the first section 105 and the third section 115.

The first section 105 includes a loop member 120, a first end 125 and a second end 130. The first section 105 can be constructed of various suitable materials including synthetic hair, an elastic band, plastic or metal wire, or thread. The first section 105 is from 0.1 mm to 4 mm wide and from 0.5 cm to 4 cm long, but can vary in length and width according to the particular application and user preference. The first end 125 and the second end 130 of the first section 105 are disposed in, and overlap with, the second section 110, while the loop member 120 is disposed outside of the second section 110.

The second section 110 includes a locking member 135. The locking member 135 is configured to couple the first section 105 to the third section 115. The locking member 135 includes various types of attachment, such as a synthetic or natural hair weft, glue, tape, rubber band(s), thread, etc., and combinations thereof. According to certain embodiments, the locking member 135 includes glue that covers the entire outer surface of the second section 110 as well as the entire inner section of the second section 110. To prevent shedding, e.g., to prevent hair residing on the inner surface of the second section 110 from slipping out of the second section 110, the hair is preferably glued in place from the outer surface through the inner surface thereof. According to certain embodiments, the locking member 135 includes glue covering the inner surface of the second section 110 and thread wrapped around the outer surface of the second section 110. According to certain embodiments, the locking member 135 includes glue covering the inner section of the second section 110, thread wrapped around the outer surface of the second section 110 or thread sewn to the first section 105 and the third section 115, and glue then covering the outside surface of the thread.

The third section 115 includes a third end 140 and a fourth end 145. The third section 115 is constructed out of human hair. The third end 140 of the third section 115 is disposed in the second section 110. The fourth end 145 is disposed outside of the second section 110, i.e., the fourth end 145 is not coupled to the first section 105 by the locking member 135. Thus, the third end 140 of the third section 115 is blended with the first end 125 and the second end 130 in the second section 110 while the fourth end 145 is not blended with the first end 125 and the second end 130.

Figure 1B:
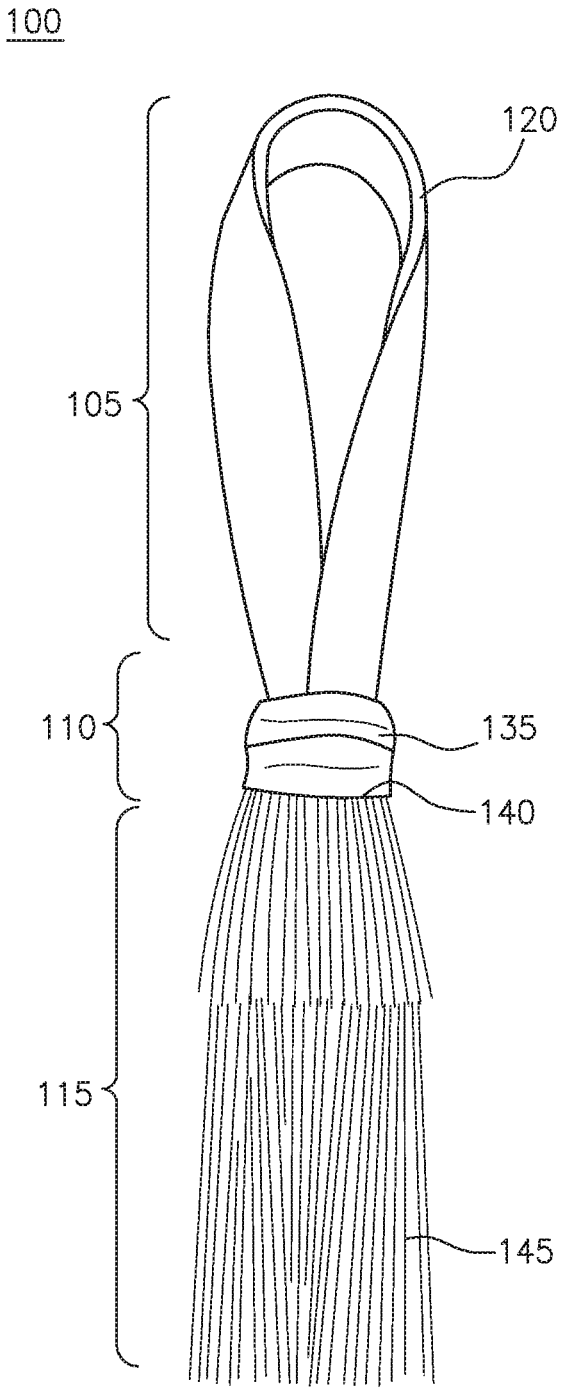
FIG. 1B illustrates an exemplary embodiment of the hair bundle apparatus according to the first embodiment.
Figure 1C:
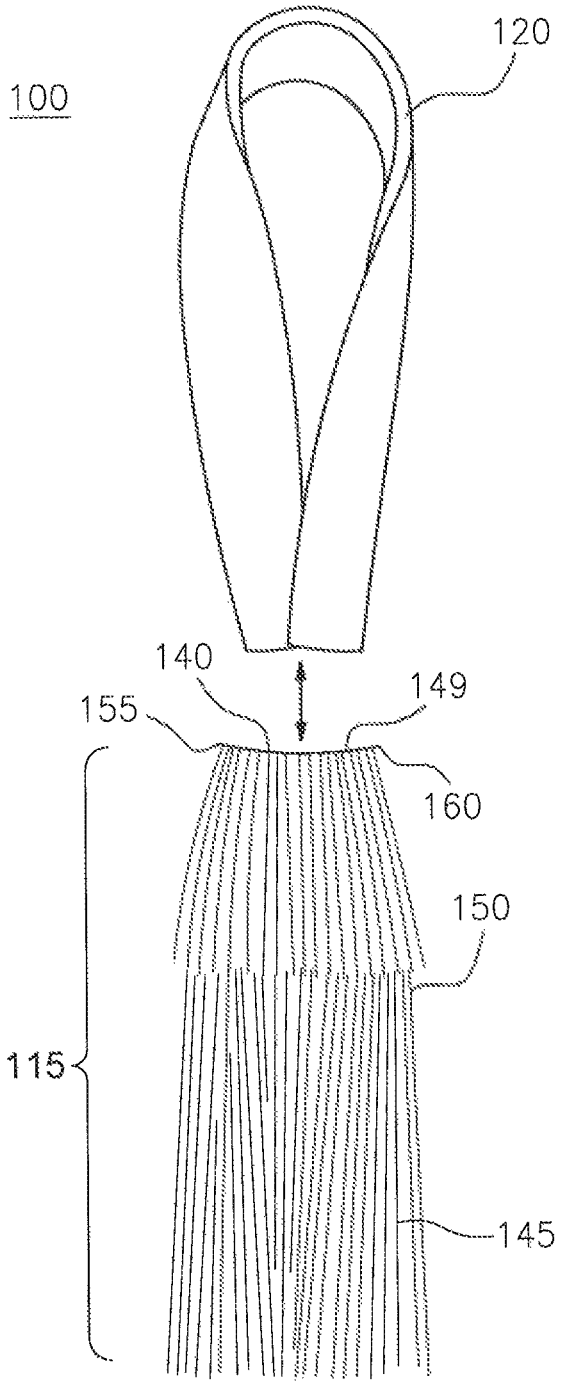
FIG. 1C illustrates the hair bundle apparatus of the first embodiment including a weft and a loop member.

FIG. 1B illustrates an exemplary embodiment of the hair bundle apparatus 100. As illustrated in FIG. 1B, the loop member 120 is an elastic band. The first end 125 and the second end 130 of the loop member 120 are twisted about 180 degrees, e.g., between 45 and 360 degrees. Twisting of the first end 125 and the second end 130 of the loop member 120 allows for the hair bundle apparatus to be easily crocheted to a wig or directly to a user's hair and also allows the loop member 120 to lay flat after being crocheted to a wig or user's hair. The third section 115 includes human hair that has been sewn to a filament 149 to form a weft 150, which is illustrated in FIG. 1C. In certain embodiments, the human hair is folded back at the third end 140 such that the third end 140 overlaps a portion of the remainder of the length of the human hair. The weft 150 includes a first weft end 155 and a second weft end 160. The first weft end 155 and the second weft end 160 are wrapped around the first end 125 and the second end 130 of the loop member 120. The locking member 135 is embodied as thread, which secures the first weft end and the second weft end to the loop member 120 by sewing the first weft end and the second weft end to the loop member 120. The locking member 135 further includes glue that covers the thread, securing the thread to the third section 115 and prevents the thread from unraveling.

A method of manufacturing the hair bundle apparatus 100 is also provided. The method includes providing the hair bundle apparatus 100 according to the embodiments described above with respect to FIGS. 1A, 1B and 1C. The method further includes twisting the first end 125 and the second end 130 of the loop member a predetermined number of degrees of rotation. The first end 125 and the second end 130 of the loop member 120 are twisted about 180 degrees, e.g., between 45 and 360 degrees. The method includes coupling the third section 115 of the hair bundle apparatus 100 to the first section 105 using the locking member 135. In certain embodiments, the method includes securing the locking member 135 around the third section using an adhesive substrate such as glue.

In certain embodiments, prior to coupling the third section 115 to the first section 105, the method includes coupling the second material to the filament 149 to form the weft 150 described above with respect to FIG. 1B and FIG. 1C. The method includes wrapping the first weft end 155 and the second weft end 160 of the weft 150 around the first end 125 and the second end 130 of the first section 105 and then coupling, e.g., by sewing with thread, the third section 115 of the hair bundle apparatus 100 to the first section 105.

In certain embodiments, the method includes cutting the weft 150 into multiple wefts such that the human hair coupled thereto comprises a predetermined weight of about 0.5 g to 3.0 g. For example, the weft 150 may be manufactured in one long continuous piece of material that is then cut into multiple smaller wefts that are then used for manufacturing the third section 115.

Figure 2A:
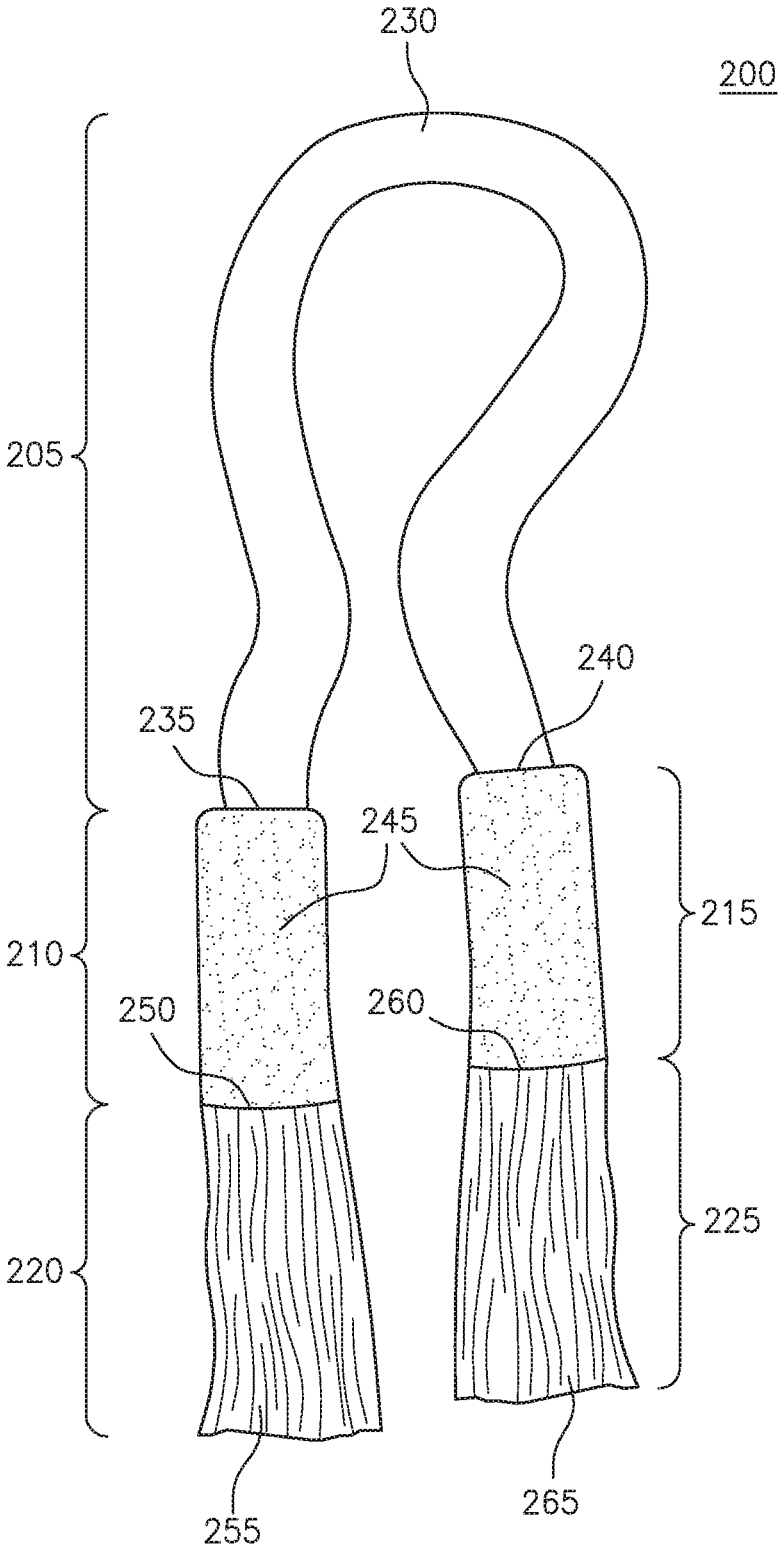
FIG. 2A illustrates a hair bundle apparatus according to a second embodiment of the present invention.

FIG. 2A illustrates a hair bundle apparatus 200 according to a second embodiment of the present invention. A method of manufacturing the hair bundle apparatus 200 is also provided herein. The hair bundle apparatus 200 includes a loop section 205, a first hair coupling section 210, a second hair coupling section 215, a first hair section 220, and a second hair section 225. The loop section 205 includes a loop member 230, a first end 235 and a second end 240. The loop section 205 can be constructed of various suitable materials including synthetic hair, an elastic band, plastic or metal wire, or thread. In certain embodiments, the loop section 205 does not include human hair, which lowers the cost of manufacture. The first end 235 and the second end 240 of the loop section 205 are disposed in the first hair coupling section 210 and the second hair coupling section 215, respectively, while the loop member 230 is disposed outside of the first hair coupling section 210 and the second hair coupling section 215.

The first hair coupling section 210 and the second hair coupling section 215 include locking members 245. The locking members 245 are configured to hold the loop section 205 to each of the first hair coupling section 210 and the second hair coupling section 215. The locking member 245 includes various types of attachment, such as a synthetic or natural hair weft, glue, tape, rubber band(s), thread, and combinations thereof. According to certain embodiments, the locking member 245 includes glue, or other suitable material, that covers the entire outer surface of the first hair coupling section 210.

According to certain embodiments, the locking member 245 includes glue, or other suitable material, that covers the entire outer surface of the first hair coupling section 210 and the second hair coupling section 215 as well as the entire inner section of the first hair coupling section 210 and the second hair coupling section 215. According to certain embodiments, the locking member 245 contacts all of the hair in the first hair section 220 and the second hair section 225 in the first hair coupling section 210 and the second hair coupling section 215, respectively. According to certain embodiments, the locking member 235 includes glue covering the inner section of the first hair coupling section 210 and the second hair coupling section 215 and thread wrapped around the outer surface of the first hair coupling section 210 and the second hair coupling section 215. According to the above embodiments, shedding is prevented, e.g., hair residing on the inner surface of the first hair coupling section 210 and the second hair coupling section 215 is prevented from slipping out of the first hair coupling section 210 and the second hair coupling section 215, the hair is preferably held in place from the outer surface through the inner surface thereof.

The first hair section 220 includes a third end 250 and a fourth end 255. The first hair section 220 is made out of natural hair. The third end 250 of the first hair section 220 is disposed in the first hair coupling section 210. The fourth end 255 is disposed outside of the first hair coupling section 210. Thus, the third end 250 of the first hair section 220 overlaps, and in certain embodiments is blended with, the first end 235 of the loop section 205 in the first hair coupling section 210.

The second hair section 225 includes a fifth end 260 and a sixth end 265. The second hair section 225 is constructed of natural hair. The fifth end 260 of the second hair section 225 is disposed in the second hair coupling section 215. The sixth end 265 is disposed outside of the second hair coupling section 215. Thus, the fifth end 260 of the second hair section 225, and in certain embodiments is blended with, the second end 240 of the loop section 205 in the second hair coupling section 215.

Figure 2B:
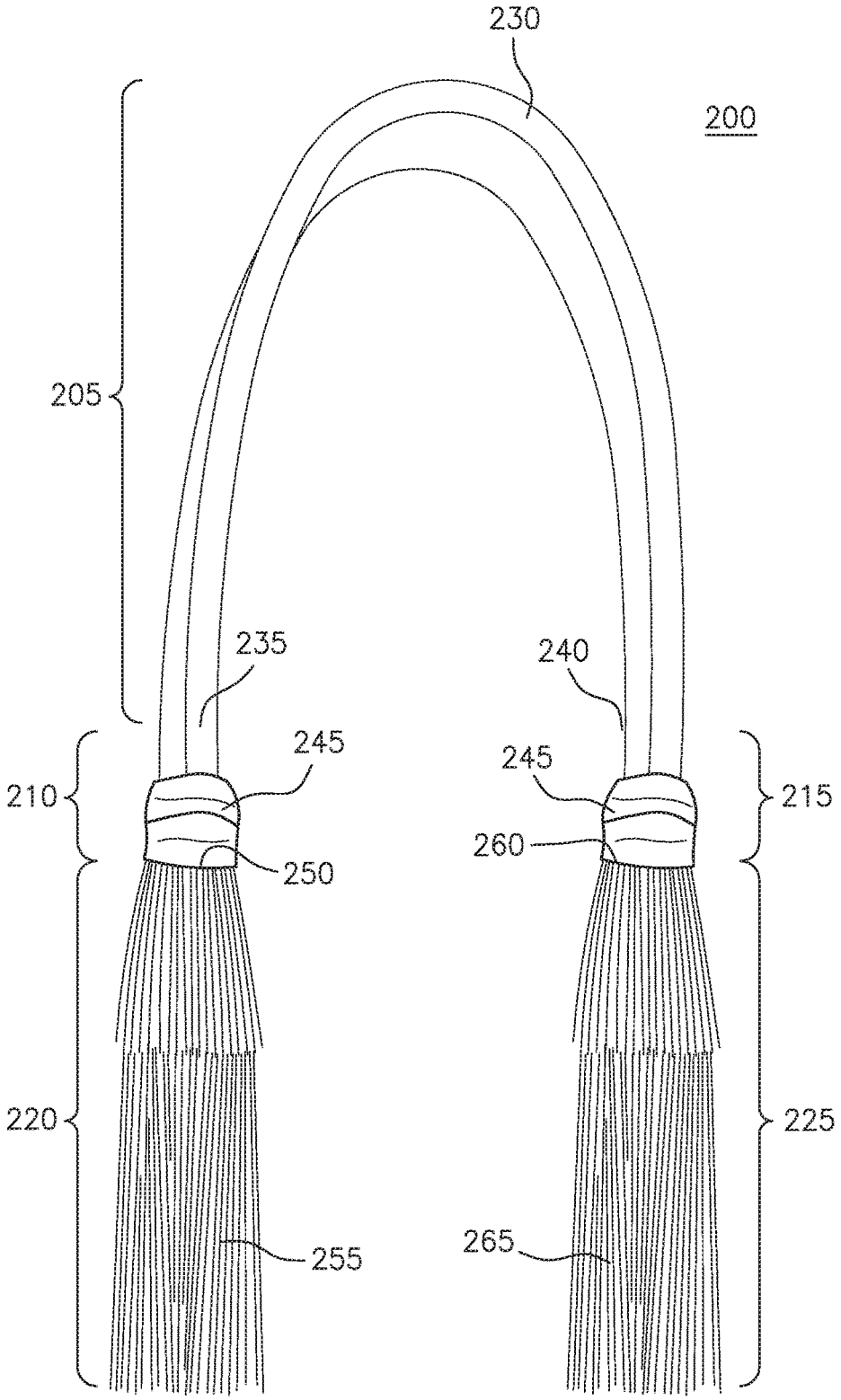
FIG. 2B illustrates an exemplary embodiment of the hair bundle apparatus according to the second embodiment.

FIG. 2B illustrates a further embodiment of the hair bundle apparatus 200. As illustrated in FIG. 2B, the loop member 230 is an elastic band. The first end 235 and the second end 240 of the loop member 230 are twisted about 180 degrees, e.g., between 45 and 360 degrees. Twisting of the first end 235 and the second end 240 of the loop member 230 allows for the hair bundle apparatus 200 to be easily crocheted to a wig or user's hair and also allows the loop member 230 to lay flat after being crocheted to a wig or user's hair.

The first hair section 220 and the second hair section 225 include human hair that has been sewn to a filament to form a weft, similarly as described above with respect to the weft 150 illustrated in FIG. 1C. In certain embodiments, the human hair is folded back at the third end 250 and the fifth end 260 such that the third end 250 and the fifth end 260 overlap a portion of the remainder of the length of the first hair section 220 and the second hair section 225, respectively. Similar to the embodiment described above with respect to FIG. 1B and FIG. 1C, the ends of the weft are wrapped around the loop member 230, with the exception that the first end 235 and the second end 240 of the loop member 230 are wrapped by separate wefts. That is, the weft includes a first weft end, a second weft end, a third weft end and a fourth weft end. The first weft end and the second weft end are wrapped around the first end 235 of the loop member 230. The third weft end and the fourth weft end are wrapped around the second end 240 of the loop member 230. The locking member 245 is embodied as thread, which secures the weft ends to the loop member 230 by sewing the weft ends to the loop member 230. The locking member 245 further includes glue that covers the thread, securing the thread to each of the first hair section 220 and the second hair section 225 and prevents the thread from unraveling.

A method of manufacturing the hair bundle apparatus 200 is also provided. The method includes providing the hair bundle apparatus 200 according to the embodiments described above with respect to FIGS. 2A and 2B. The method includes coupling the first end 235 of the loop member 230 to the first hair section 220 using a first locking member 245 and coupling the second end 240 of the loop member 230 to the second hair section 225 using a second locking member 245.

In certain embodiments, prior to coupling the first end 235 of the loop member 230 to the first hair section 220 and prior to coupling the second end 240 of the loop member 230 to the second hair section 225, the method includes coupling the second material to a first filament to form a first weft and coupling the third material to a second filament to form a second weft. In certain embodiments, coupling the second material to the first filament and coupling the third material to the second filament comprises sewing the second material to the first filament and sewing the third material to the second filament. The first weft and the second weft each weigh about 0.5 g to 3.0 g. Additionally, prior to coupling the first end 235 of the loop member 230 to the first hair section 220 and prior to coupling the second end 240 of the loop member 230 to the second hair section 225, the method includes wrapping the first weft end and the second weft end of the first weft around the first end 235 of the loop member 230 and wrapping and the third weft end and the fourth weft end of the second weft around the second end 240 of the loop member 230. The method includes then coupling the first end 235 of the loop member 230 to the first hair section 220 and coupling the second end 240 of the loop 230 to the second hair section 225.

In certain embodiments, the method includes securing the first locking member and the second locking member around the first hair section 220 and the second hair section 225, respectively, using an adhesive substrate.

Figure 3:
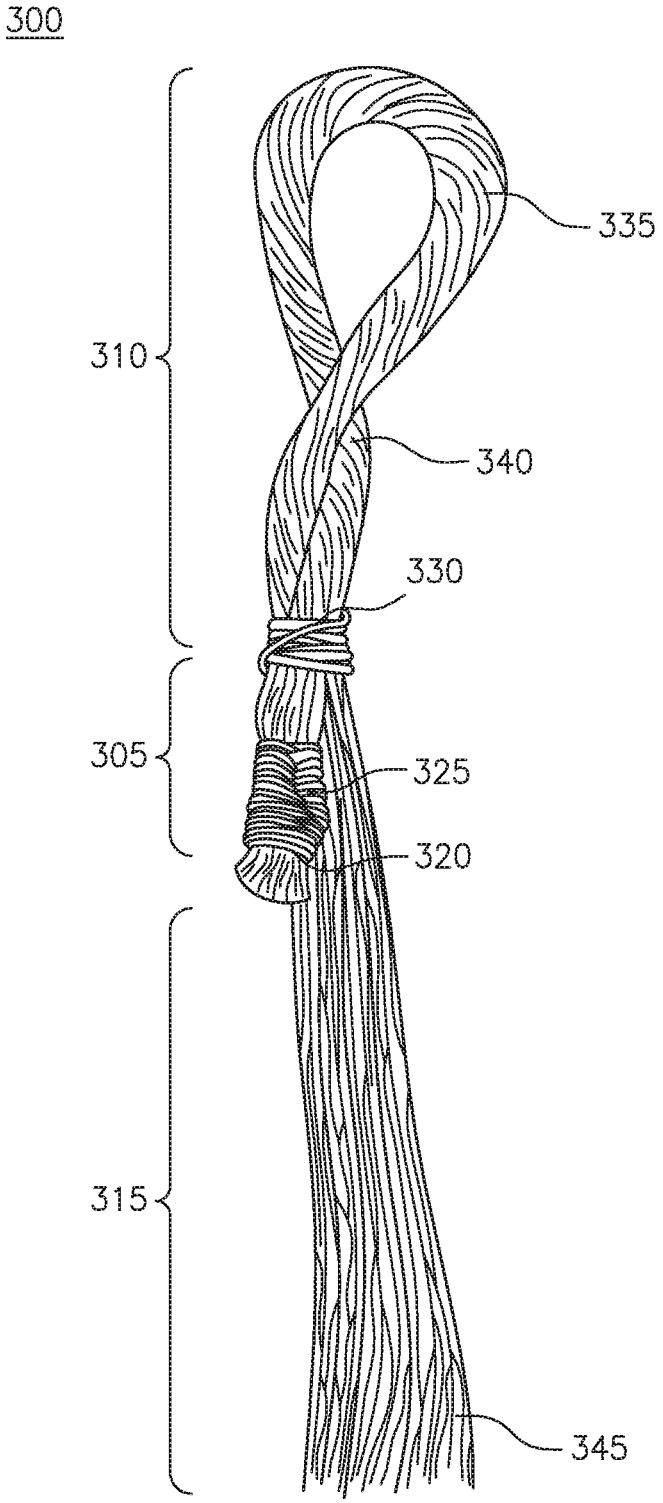
FIG. 3 illustrates a hair bundle apparatus according to a third embodiment of the present invention.

FIG. 3 illustrates a hair bundle apparatus 300 according to a third embodiment of the present invention. The hair bundle apparatus 300 is constructed of multiple strands of human hair, coupled together in a bundle. The hair bundle apparatus 300 differs from the hair bundle apparatus 100 and the hair bundle apparatus 200 in that the hair bundle apparatus 300 does not have multiple separate sections. The hair bundle apparatus 300 is constructed of continuous strands of human hair.

The hair bundle apparatus 300 includes a first region 305, a second region 310 and a third region 315. The first region 305 is located at a first end 320 of the hair bundle apparatus 300. The first region 305 includes a locking member 325. The locking member 325 includes various types of attachment, such as a synthetic or natural hair weft, glue, tape, rubber band(s), thread, and combinations thereof. The locking member 325 wraps around the strands of human hair, securing the strands of human hair together at the first end 320. The second region 310 of the hair bundle apparatus 300 is secured to the third region 315 by an adjustable wrap member 330. The adjustable wrap member 330 is configured to couple the second region 310 to the third region 315 by wrapping around both the second region 310 and the third region 315. The adjustable wrap member 330 is constructed of, for example, a rubber band, string, synthetic hair, natural hair, or other suitable material. For example, the adjustable wrap member 330 may be the product marketed as the Flexi-Lock™. In the second region 310, the strands of human hair are turned to a U-shape, forming a loop region 335. In certain embodiments, the loop region 335 is about 1-5 cm long, but can vary in length according to the particular application and user preference.

The strands of human hair in the loop region 335 are rotated a predetermined number of rotations, which results in the loop region 335 including a predetermined number of twists to form a twisted configuration 340. It is noted that the twisted configuration 340 refers to the structure of the loop region 335, but twisting of the loop region 335 is also included in the method of manufacture of the hair bundle apparatus 300. In certain embodiments, the strands of human hair in the loop region include at least one 180 degree rotation. In certain embodiments, the strands of human hair in the loop region include at least one 360 degree rotation. The adjustable wrap member 330 is configured to slide up and down along the first region 305 and the second region 310, making the loop region 335 smaller and larger in order to tighten and loosen, respectively, the hair bundle apparatus 300 to a user's hair or to a wig. The third region 315 includes a second end 345 of the hair bundle apparatus 300. The third region 315 is disposed below the locking member 325. In the third region 315, the strands of human hair are not constrained and can be combed and styled according to a user's preference. In certain embodiments, the strands of human hair in the hair bundle apparatus 300 do not include synthetic hair or animal hair, which provides a high-quality and desirable product for users.

A method of manufacturing the hair bundle apparatus 300 is also provided. The method includes securing the first region 305 of human hair with, for example, the locking member 325. The locking member 325 is secured to the human hair at a first predetermined position, including, for example, at the first end 320. The method includes temporarily securing the third region 315 at a second predetermined position, the first region 305 is then turned to form the U-shaped loop member 335. The first region 305 is rotated a predetermined number of rotations until the loop member 335 twists to form the twist member 340. The adjustable wrap member 330 is then coupled to the second region 310 and the third region 315 of the hair bundle, securing the second region 310 to the third region 315.

According to the embodiments described herein, users of crochet-style wigs are now able to cost-effectively use human hair to form their desired wig. Furthermore, users can attach the hair bundle apparatus directly to their own hair. The hair bundles described herein can be configured according to any length desired by a user. Thus, users can have the benefits of hair extensions made with human hair, whether used with a crochet-style cap or attached directly to the user's hair, that is easily customizable to their desired appearance and style.

While embodiments of the invention have been shown and described with reference to certain embodiments thereof, it will be understood by those skilled in the art that various changes in form and details may be made therein without departing from the spirit and scope of the invention and equivalents thereof.

The invention claimed is:

1. A hair bundle apparatus comprising:

a first section comprising a loop member, a first end and a second end, wherein the firm section is constructed of a first material comprising one of synthetic hair, an elastic band, and thread;

a second section comprising a locking member; and a third section comprising a third end and a fourth end, wherein the third section constructed of a second material comprising human hair, wherein the third section is folded back such that a portion of the third end overlaps a portion of the remainder of a length of the third section, wherein the third end of the third section is coupled to a filament to form a weft, and wherein the weft comprises a first weft end and a second weft end, and wherein the first weft end and the second weft end are wrapped around the first end and the second end of the loop member.

2. The hair bundle apparatus according to claim 1, wherein the second section is disposed between the first section and the third section.

3. The hair bundle apparatus according to claim 1, wherein the first material and the second material overlap in the second section.

4. The hair bundle apparatus according, to claim 1, wherein the locking member is configured to couple the first section to the third section.

5. The hair bundle apparatus according to claim 1, wherein the fourth end is disposed outside of the second section.

6. The hair bundle apparatus according to claim 1, comprising:

wherein the first section comprises a loop section comprising the loop member, the first end and the second end, wherein the loop section is constructed of the first material comprising one of synthetic hair, an elastic band, wire, and thread;

wherein the locking member comprises a first locking member and a second locking member, wherein the second section comprises a first hair coupling section comprising the first locking, member and a second hair coupling section comprising the second locking member, and wherein the third section comprises a first hair section comprising the third end and the fourth end, wherein the first hair section is constructed of the second material comprising human hair and a second hair section comprising a fifth end and a sixth end, wherein the second hair section is constructed of a third material comprising human hair.

7. The hair bundle apparatus according to claim 6, wherein the first hair coupling section is disposed between the loop section and the first hair section, and wherein the second hair coupling section is disposed between the loop section acid the second hair section.

8. The hair bundle apparatus according to claim 6, wherein the first end of the loop section is disposed in the first hair coupling section, acid wherein the second end of the loop section is disposed in the second hair coupling section.

9. The hair bundle apparatus according to claim 8, wherein the third end of the first hair section is disposed in the first hair coupling section, and wherein the fifth end of the second hair coupling section is disposed in the second hair coupling section.

10. The hair bundle apparatus according to claim 6, wherein the first material overlaps with the second material in the first hair coupling section, and wherein the first material overlaps with the third material in the second hair coupling section.

11. The hair bundle apparatus according to claim 6, wherein the locking member contacts substantially all of the first material in the first hair section and substantially all of the third material in the second hair section.

12. The hair bundle apparatus according to claim 6, wherein the loop section does not comprise human hair.

* * * * *